US006164185A

United States Patent [19]

Granbom

[11] Patent Number: 6,164,185

[45] Date of Patent: Dec. 26, 2000

[54] BRAKING DEVICE OF LINEAR MOVING OPERATING DEVICES

[76] Inventor: Bo Granbom, Kolungens Gård, S-464 92, Mellerud, Sweden

[21] Appl. No.: 08/973,800

[22] PCT Filed: Mar. 26, 1997

[86] PCT No.: PCT/SE97/00536

§ 371 Date: Dec. 9, 1997

§ 102(e) Date: Dec. 9, 1997

[87] PCT Pub. No.: WO97/44587

PCT Pub. Date: Nov. 27, 1997

[30] Foreign Application Priority Data

May 22, 1996 [SE] Sweden ..... 9601939

[51] Int. Cl.[7] ..... F15B 15/26

[52] U.S. Cl. ..... 92/19; 92/28; 92/88

[58] Field of Search ..... 92/18, 19, 28, 92/88

[56] References Cited

U.S. PATENT DOCUMENTS 2,200,427 5/1940 Merx ..... 92/28

5,111,913 5/1992 Granbom ..... 92/88

5,205,204 4/1993 Gottling et al. ..... 92/28

*Primary Examiner*—F. Daniel Lopez

[57] ABSTRACT

A brake for linear movement devices comprising a device. The brake means includes a bar which extends parallel with the path of movement of the device and which accommodates a pressurizable hose-like element that extends along the bar. The invention is characterized by a slat spring accommodated in the bar and extending on one side of the hose-like element, a brake disposed along the slat spring and movable transversely to the longitudinal direction of the hose-like element and the spring and located adjacent one longitudinally extending edge of the spring, for movement transversely to the longitudinal direction and essentially in the plane of the spring when the hose-like element is placed under pressure and the spring is flexed outwardly. The brake also includes a slide shoe which is guided in the rail and connected to the device and actuable by the brake device that is movable towards the slide shoe.

5 Claims, 3 Drawing Sheets

BRAKING DEVICE OF LINEAR MOVING OPERATING DEVICES

FIELD OF THE INVENTION

The present invention relates to brake means in linearly moving operating devices which is reciprocatingly movable along the device. More particularly, there is provided a brake means for a piston, compressed air cylinders, and the like.

BACKGROUND OF THE INVENTION

Linearly moving operating devices have a wide field of use. The term linearly moving operating device shall be understood to include pressure fluid cylinders that operate with compressible media, such as compressed air. Linearly moving operating devices shall also be understood to include hydraulic cylinders and so-called ball screws. In the case of the first-mentioned operating devices, i.e. devices that work with compressible media, serious difficulties are experienced in braking and holding the piston-rod in desired positions. By braking is meant both progressive retardation of the piston and abrupt braking or holding the piston stationary. Examples of different solutions for braking the movement of pressure cylinders, particularly pneumatically operated cylinders, are found described in Swedish Patent Specifications 465 530, 465 888 and 465 899. These solutions include the use of a bar or rail along which a slide guided by the rail and connected to the piston of the cylinder can be locked. The solutions proposed, however, are relatively complicated and therewith expensive to implement, and the locking force generated by such devices is much too low to ensure safety in vertical applications.

The present invention, as defined in the characterizing clauses of respective claims, provides brake means for, e.g., compressed air cylinders and corresponding linearly moving operating devices that is of simple construction and highly reliable in operation by virtue of the very significant locking force generated by said brake means.

BRIEF DESCRIPTION OF THE DRAWINGS

The invention will now be described in more detail with reference to exemplifying embodiments thereof and also with reference to the accompanying drawings, in which.

DESCRIPTION OF THE PREFERRED EMBODIMENTS

Figure 1:
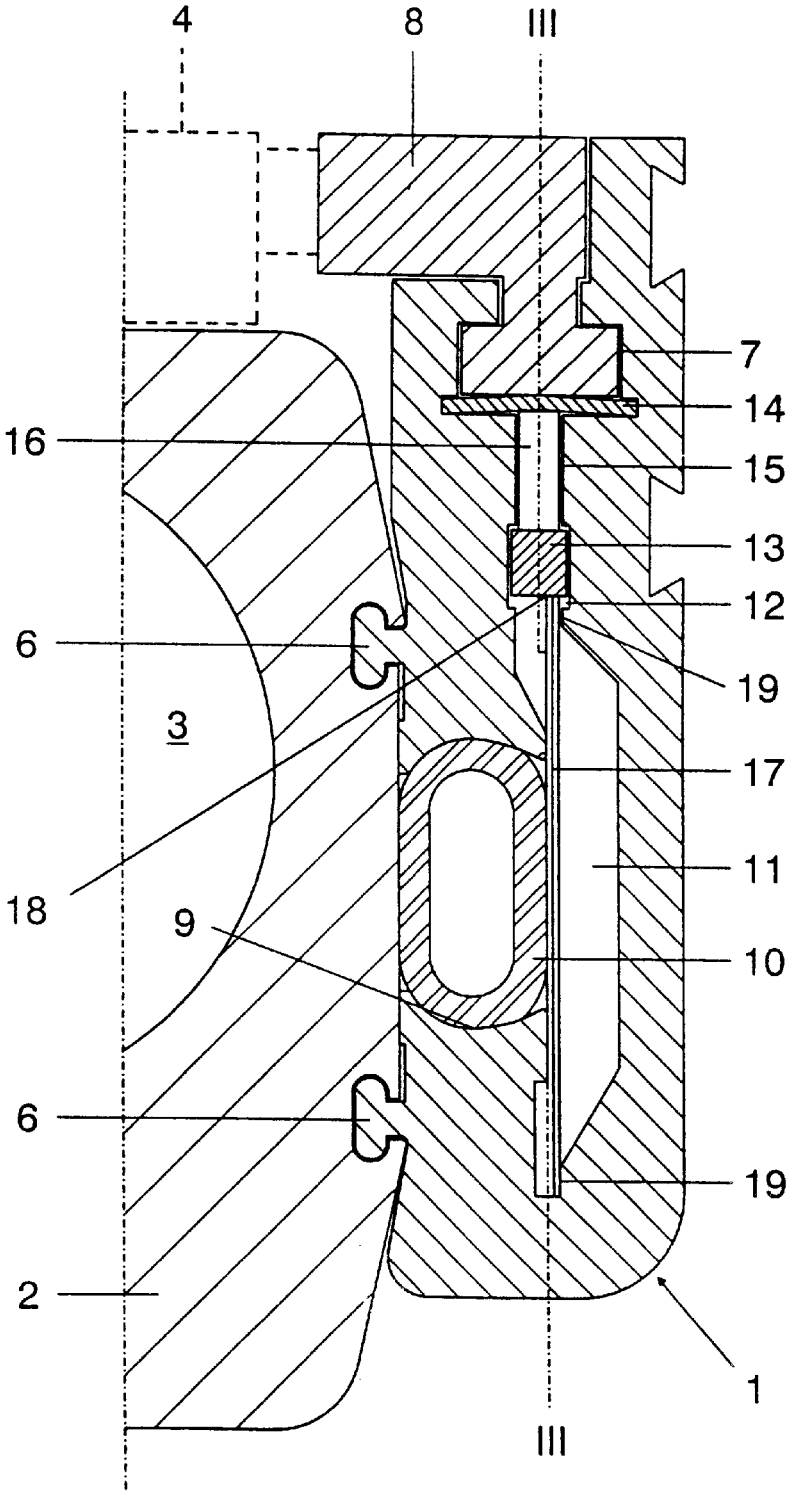
FIG. 1 is a sectional view of inventive brake means.
Figure 2:
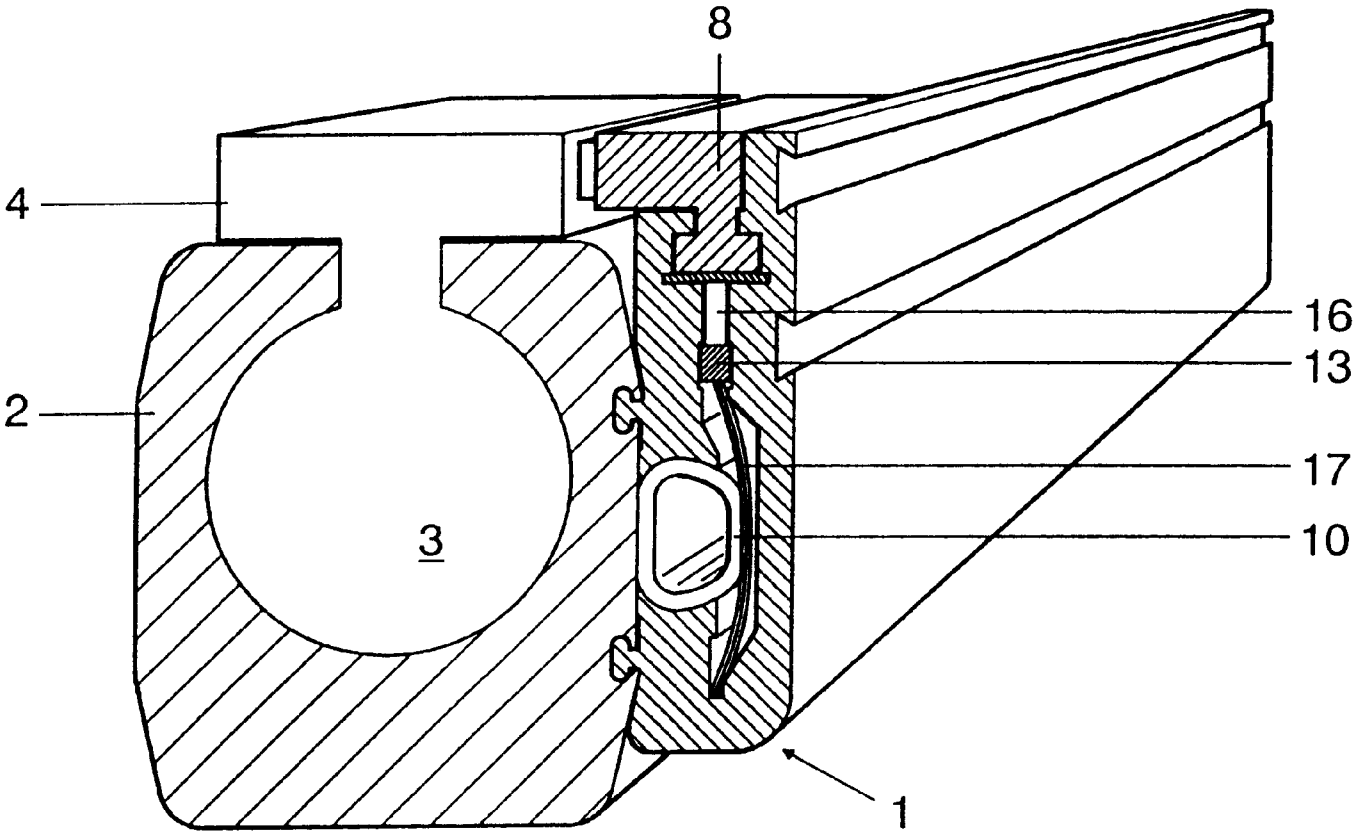
FIG. 2 is a cut-away perspective view of the brake means in a deactivated state.

FIGS. 1 and 2 illustrate brake means 1 mounted in a cylinder 2 which, in the illustrated case, does not have a piston rod but which instead includes a slot that extends along the length of the cylinder and that receives a dogging element 4 mounted on a reciprocatingly movable piston 3 on one side of the cylinder. The slot is typically sealed with the aid of a steel band. The cylinder may, of course, be of some other kind and forms no part of the present invention. The brake means 1 includes a bar 5 which is fitted to the cylinder 2 by means of a male and female connector means, indicated at 6, to form a unit with said cylinder. Formed in the top end of the bar 5 is a groove 7 which has the shape of an inverse T and which guidingly receives a slide shoe 8. The slide shoe 8 is connected to the dogging element 4 for movement together with said element upon activation of the piston 3.

Figure 3:
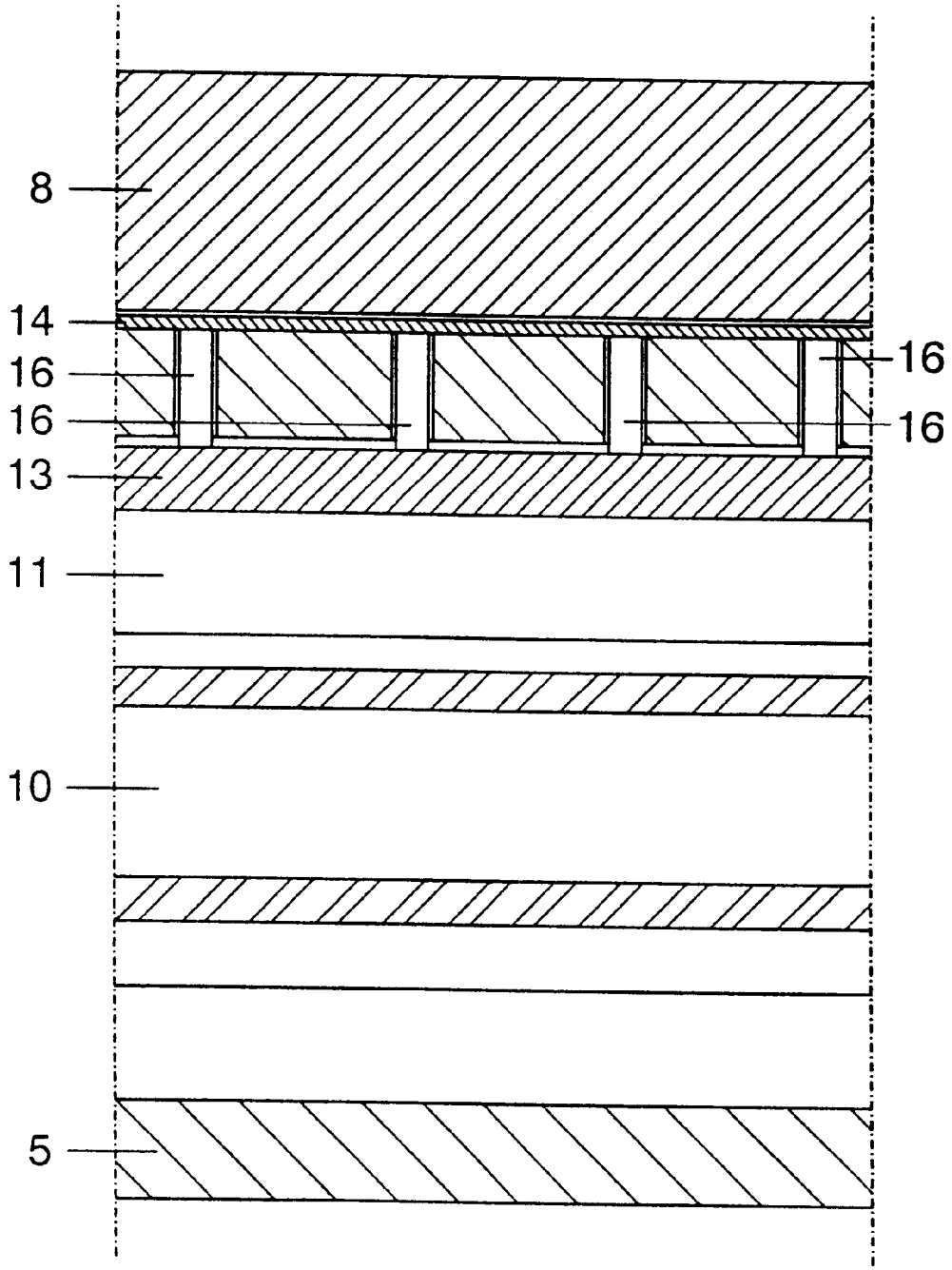
FIG. 3 is a schematic, part-sectioned view of the brake means taken on the line III—III in FIG. 1.

Extending along the length of the bar 5 is a hollow cavity 9 which accommodates a hose-like element 10. The cavity is open to a channel 11 which is vertical in the figure and the vertical extension of which is much greater than the vertical extension of the cavity 9 and the top of which is terminated by an essentially square-section guide groove 12. Inserted into the groove 12 is a square-section profile 13 that is able to move to a certain extent vertically in the guide groove 12. A steel band 14 is mounted in the bottom of the I-shaped groove 7. The bar 5 includes holes 15 in which pins 16 are disposed uniformly along the length of the bar, see FIG. 3. The channel 11 accommodates a slat spring 17, with the upper edge 18 of the spring located beneath the bottom side of the profile 13, and the bottom edge of the spring 17 resting on the bottom of the channel 11. It will be understood that the slat spring extends along the full length of the bar 5. One side of the spring 17 supports against the hose-like element 10 and its other side support against abutment surfaces 19 that extend along the edges of the spring.

The hose-like element is connected to a source of compressed air, not shown, and can be pressurized as required with the aid of said compressed air source.

The hose-like element is shown inactive in FIG. 1, i.e. not pressurized, and the slat spring 17 is in a non-activated state and therewith extends flat between the two abutment surfaces 19. The width of the spring 17 is adapted so that with the spring in the state shown in FIG. 1 the upper edge 18 of the spring will press against the profile 13 which, in turn, lifts the pins 16 against the steel band 14, wherewith the steel band presses against the underside of the slide shoe 8 and locks the same, and therewith also the dogging element 4, in place. When pressure is applied to the hose-like element 10, as shown in FIG. 2, the spring 17 will be flexed outwards, thereby reducing the "straight" distance between the edges of the spring 17. This relieves the load on the profile 13 and the pins 16, so as to release the steel band 14 from the slide shoe 8 and allow the shoe to move freely along the bar 5. The slat spring 17 straightens-out immediately the hose-like element 10 is de-pressurized, therewith applying a braking force on the slide shoe 8 and the dogging element 4 with the piston 3. A fault in the activation system of the hose-like element 10 will therefore automatically cause the brake means to apply a braking force, which prevents the risk of operating faults and accidents.

The slat spring 17 is preferably comprised of several mutually abutting slat layers, such as a multi-layer spring, as indicated in FIGS. 1 and 2.

It will be understood that the invention is not restricted to the illustrated embodiment and that modifications and variations can be made within the scope of the following claims and that the bar, the slide shoe, the profile 13 and the channel 11 may have forms different to those shown. The hose-like element 10 can be pressurized with the aid of air or some other gas, or with other pressure means, such as hydraulic fluid for instance.

What is claimed is:

1. In a brake means for linearly moving operating devices that include a drive means, which is reciprocatingly movable along the operating device, wherein the brake means includes a bar that extends parallel with the path of movement of said drive means and which accommodates a pressurizable hose-like element extending along the bar, the improvement which comprises a slat spring mounted in the bar and extending along one side of the hose-like element, a brake device disposed along said slat spring and movable transversely to a longitudinal direction of the hose-like element and said slat spring and located adjacent one longitudinal edge of said slat spring for movement transversely to said longitudinal direction and substantially in a plane of said slat spring when the hose-like element is placed under pressure and said slat spring outwardly flexed, and further comprising a slide shoe which is guided in said bar and connected to said drive means and which is selectively actuated by said brake device that moves towards the slide shoe.

2. Brake means according to claim 1, wherein said slat spring is supported by two abutment surfaces along longitudinally extending edges on a side opposite to the hose-like element, where said slat spring is generally straight when the hose-like element is inactive, and wherein said slide shoe is braked by said brake device when said slat spring is in its straight state.

3. Brake means according to claim 1 wherein said brake means includes a profile which extends along said spring edge and which is movable away from the slide shoe when the slat spring is flexed outwards as the hose-like element is placed under pressure.

4. Brake means according to claim 3, further comprising a row of pins disposed along the profile, between said profile and the slide shoe guided in said rail, said pins acting on a band mounted between said pins and said slide shoe and extending along the path of movement of the slide shoe.

5. Brake means for a fluid pressure device having a piston which is reciprocatingly movable along the device, said brake means having a bar which extends parallel with the path of movement of the piston and cooperates with a pressurizable hose-like element that extends along the bar, a slat spring in said bar and extending on one side of the hose-like element, a brake device disposed along the slat spring and movable transversely to the longitudinal direction of the hose-like element and the slat spring, said brake device being located adjacent one longitudinally extending edge of the slat spring for movement transversely to said longitudinal direction and essentially in a plane of the slat spring when the hose-like element is placed under pressure and the slat spring is flexed outwardly, said brake means also including a slide shoe which is guided in said bar and connected to the piston and actuable by the brake device that is movable towards the slide shoe.

* * * * *